United States Patent [19]

Macfarlane

[11] 4,253,577

[45] Mar. 3, 1981

[54] GARMENT HANGER

[76] Inventor: Elmer P. Macfarlane, P.O. Box 139, Rogue River, Oreg. 97539

[21] Appl. No.: 775,610

[22] Filed: Mar. 8, 1977

[51] Int. Cl.[3] ..... A47F 5/01

[52] U.S. Cl. ..... 211/118

[58] Field of Search ..... 211/113, 119, 118, 104; 223/91, 96

[56] References Cited

U.S. PATENT DOCUMENTS

| | | | |
|---|---|---|---|
| 2,244,355 | 6/1941 | Britner | 223/91 |
| 2,577,397 | 12/1951 | Bailey | 211/119 X |
| 2,662,645 | 12/1953 | Piton | 211/104 X |
| 2,675,130 | 4/1954 | Dore | 211/119 X |
| 2,904,234 | 9/1959 | Pinkham | 223/91 |
| 2,907,472 | 10/1959 | Cook | 223/91 X |
| 3,352,430 | 11/1967 | McAtee | 211/119 |
| 3,920,127 | 11/1975 | LaBeaud | 211/118 |
| 3,945,543 | 3/1976 | Lazaroff | 211/119 X |

FOREIGN PATENT DOCUMENTS

| | | | |
|---|---|---|---|
| 444805 | 2/1968 | Switzerland | 211/113 |

*Primary Examiner*—Roy D. Frazier
*Assistant Examiner*—Robert W. Gibson, Jr.

[57] ABSTRACT

The present invention relates to a clothes hanger that can be freely moved from one hanger supporting hook or rod to another, the hanger including a hanger frame, and a rack pivotally mounted thereon for movement about a fixed horizontal axis, that comprises spaced parallel rods on each of which one or more garments or other fabric articles can be draped. The rack is swingable between an up position in which the groups of articles draped on the several individual rods are pushed together, and a lowered, horizontal or nearly horizontal position in which the articles draped on each rod may be well spaced from articles draped on an adjacent rod or rods. It is a salient feature, in a hanger of the kind referred to, that any article so draped can, when the rack is in lowered position, be withdrawn from its supporting rod in a direction lengthwise of the rod.

1 Claim, 5 Drawing Figures

GARMENT HANGER

DESCRIPTION OF INVENTION

In prior portable hangers for clothes and kindred articles having a suspendable hanger frame and a rack comprising spaced, parallel, horizontal rods mounted thereon, it has not been feasible to drape superposed articles on a given rod because the underlying articles could not be withdrawn lengthwise of the rod.

If the articles were draped, one on another, any wanted article would have to be lifted clear of the rod, and if the wanted article was an inner article of those on the involved rod, all the unwanted overlying articles would have to be taken off, either with it or one after another, tediously rearranged, and put back on the rod. Each rod was accordingly provided with clothespins for suspending garments such as trousers singly, full length from the rack.

By providing for lateral withdrawal of garments from the rack (length-wise of the rods) it is made feasible to drape superposed garments or other articles in groups on each rod and to withdraw any chosen garment or article by merely inserting a forearm between the garment wanted and the overlying unwanted garment or garments, and then laterally pulling the wanted garment clear with the free hand.

The fact that draping of superposed articles is made feasible, goes to the very heart of feasibility of the entire scheme, because multiple draping not only increases the capacity of the hanger, but it also cuts in half the floor clearance that must be provided for. If articles having the length of trousers, for example, must hang full length when the rack is down, this would generally preclude the use of the hanger in a passenger vehicle. In a closet a shelf generally restricts the level at which a hanger rod or hook can be provided so that trousers, for example, hanging full length from the lower rods of the rack, would be partially on the floor.

If the hanger is being used by two persons of unequal height the hanger should be hung low enough so that the shorter person can unlatch the rack and let it down to a chosen level at which the rack rods are well spaced horizontally but the longer garments, draped on all of the rack rods, hang clear of the floor or ground.

In the drawing forming part of this specification:

FIG. 3 is an elevational view from the right side of the carrier illustrating its appearance when hung from a carside hook, with a partial cut-away of the right hand main support frame leg. This view illustrates the appearance of the rack when down, a minimum of 70 degrees at the loading and unloading position;

Figure 1:
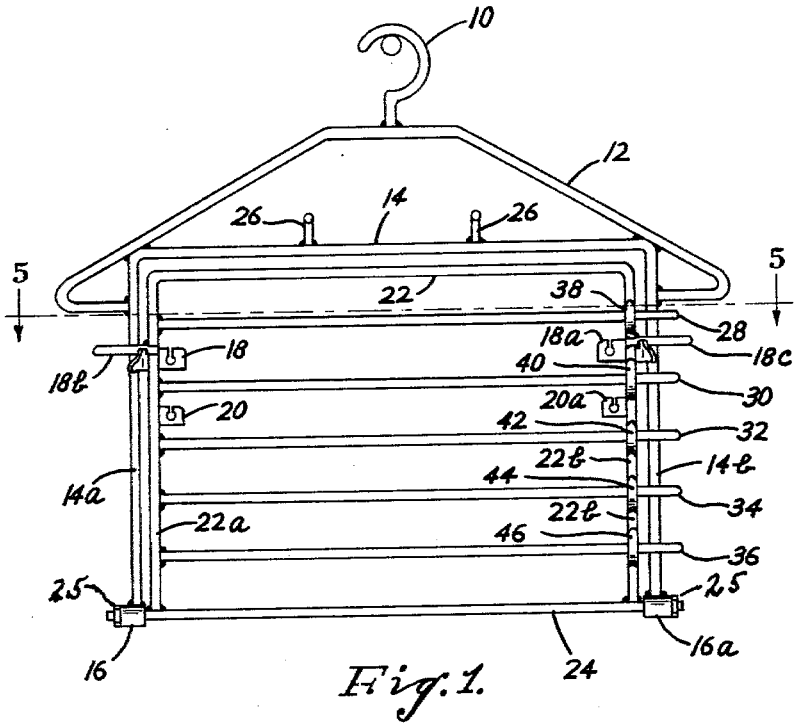
FIG. 1 is a view in front elevation of my composite garment hanger with the rack in storage position, but with chain limit-stops and elastic chain tenders omitted to give a clearer view of the configuration and disposition of certain chain hooks.

FIG. 4 is an elevational view from the right side of the hanger, similar to FIG. 3, showing the rack in storage position when hanging from a hook on a door or wall, and showing the hanging inclination of pants in relation to one another when in storage position; and FIG. 5 is a horizontal, cross-sectional view of the hanger from above with the rack in storage position, the section being taken on line 5—5 of FIG. 1, looking in the direction of the arrows.

Following is a detailed description of all parts of a preferred embodiment of the invention and an explanation of the purpose and function of each part as represented in the individual drawings described above.

Figure 2:
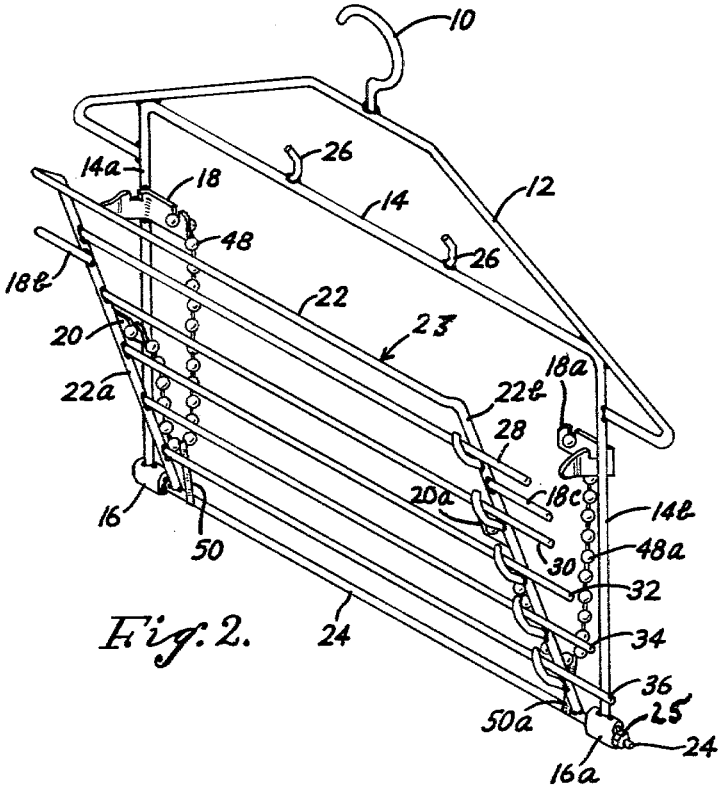
FIG. 2 is a perspective view of the garment hanger of FIG. 1 with the rack released from storage position and beginning its travel downward to loading and unloading position.

A main hanger hook 10 is formed from larger diameter wire than the other parts of the hanger to carry the total garment load. The hook 10 is connected to the coat and dust cover hanger 12. A stiffener rod 14 doubles as support for hanging accessories; it is formed integral with **14*a*, the left hand main support frame leg, and 14*b* the right hand main support frame leg, and with them makes up the complete support frame. The support frame 14, 14*a* 14*b* is inserted into the hanger 12 from below and is coplanar therewith. The corners at either end of 14 intersect the under side of 12 and are connected thereto, maintaining a common plane therewith. The horizontal ends below the shoulder points of 12 contact the outer sides of 14*a* and 14*b* and are permanently joined thereto, as by welding. Connected to the respective bottom ends of 14*a* and 14*b* are bearing members 16 and 16*a*. The bearing members 16 and 16*a* are identical flattened, tubular sleeves, formed with oblong holes slightly larger in width than the diameter of a connecting rod 24, and are attached to 14*a* and 14*b* with their side openings in alignment with each. The oblong openings in 16 and 16*a* extend vertically. The sleeves 16 and 16*a* extend a predetermined distance inboard relative to the respective support legs 14*a* and 14*b* to which they are attached; the purpose of this being to maintain a predetermined gap between the main support frame legs (14*a* and 14*b*) and the rack support legs 22*a* and 22*b*, as plainly shown in FIG. 1. Distinctive right and left hand combination catch and chain hook fittings 18 and 18*a* are affixed, respectively, to 14*a* and 14*b*, being formulated from flat stock or strap, a maximum of one-sixteenth inch thick, and bent in opposition to each other at ninety degree angles. The fittings 18 and 18*a* are attached to the inboard sides of legs 22*a* and 22*b* at the same elevation as shown in FIG. 2 and FIG. 5. The distance from the bottom of the catches or notches in 18 and 18*a* to the bottom of the sleeve holes in 16 and 16*a* is precisely the same distance as that measured from the bottom of the catch rods 18*b* and 18*c* to the bottom of a pivot bar 24**. The depth of the catch notches is desirably the same as the diameter of the catch rods.

Catch rods **18*b* and 18*c* normally lie in the notches of 18 and 18*a* to maintain the rack 23 in vertical or storage position. The weight of the carriage with the help of the garments keeps the rods 18*b* and 18*c* in the catches 18 and 18*a***.

Lower chain hooks 20 and **20*a* are provided on the rack legs 22*a* and 22*b* for connection to the lower ends of chains 48 and 48*a*, to limit the extent to which the rack 23 can be lowered. The catch rods 18*b* and 18*c* are attached to the front side of the carriage support legs 22*a* and 22*b*, respectively, and at a predetermined position with the rods extending outboard in opposite directions as shown in FIGS. 1, 2 and 5**.

A lifting bar 22 is grasped with thumb and fingers to lift the catch rods **18*b* and 18*c* out of their respective catches 18 and 18*a* preparatory to lowering the garment carriage seventy degrees to a more or less horizontal position as shown, for example, in FIG. 3. The lifting bar 22 is formed integral with the rack legs 22*a* and 22*b* and is offset forward, for easier grasping and lifting, by placing a minimum bend of forty-five degrees at one-half inch below the ninety degree corners at each end of 22**.

The pivot bar 24 is connected to the ends of 22*a* and 22*b*, the rack legs and the connecting bars, with the exception of 22, being disposed in a common plane and forming a rectangular rack frame. The ends of pivot bar 24 have short end threads that extend through the two sleeves 16 and 16*a* and are preferably secured by lock nuts 25. The nuts are safetied by staking the threads or other suitable means. Belt hooks 26 are connected to the stiffener rod 14, as may be desired or practical, and conveniently located in generally vertical or upright positions as shown in FIGS. 1, 2 and 3.

Parallel bars 28, 30, 32, 34 and 36 are the primary hanger bars of the rack, and are identical to each other. One end of each is connected to rack leg 22*a* by lap welding. These bars extend horizontally and are parallel to one another and are preferably located a minimum of one and five-eighths inches apart. The free ends extend toward the right, crossing both 22*b* and 14*b*. The free ends of said hanger bars extend desirably about three-fourths of an inch beyond 14*b*. The last quarter inch of the free ends can desirably be bent forward a maximum of thirty degrees to aid in finger-tip manipulation. They act like an inverted "Sled runner" when loading the pants onto the rack. All open ends of bars or rods are rounded to avoid snagging of the garments.

Parts 38, 40, 42, 44 and 46 are the hanger bar hooks connected to the front surface of leg 22*b* and are spaced to carry the free ends of the hanger bars in parallel, horizontal positions and remain so except when loading or unloading one or more articles. The hanger bar hooks 38 through 46 are normally placed in upright position, the upper ends gapped just enough to allow the user to swing the free ends of the hanger bars out of the hooks individually as indicated in FIG. 3 part 34. Also in FIG. 3 as the rack pivots down toward horizontal, the garments continue to hang vertically and thus become separated side by side so that any individual one can be removed and replaced from its hanger bar, by removing the free end of the bar from its supporting hook and sliding the garment off. When replacing an article, the article is folded over the right forearm and hand. If the garment is a pair of trousers the crease is placed even with the finger tips of the right hand. The right hand finger tips are placed in contact with the free end of the hanger bar. With the left hand the operator reaches either under the rack or over the rack, grasps the creases of the trousers and slides them to the left, off of the right arm, and onto the selected hanger bar.

Lengths of chain, preferably heavy bead chain, 48 and 48*a*, are desirably long enough to allow the rack to lower at least seventy degrees below vertical with a few extra links or beads to permit adjustment to a greater degree if desired. The ends of each chain are placed in the chain hook slots 18 and 20 or 18*a* and 20*a*, respectively, one chain to each side of the hanger assembly. When the rack is lowered to loading position, it hangs on the chains in a fixed position, allowing both hands to be free for loading and unloading of garments. To then fold the rack to the storage position, the lift bar 22 is grasped and pivots the rack up until the catch rods 18*b* and 18*c* strike the inclined upper front surfaces of the catch fittings 18 and 18*a*, illustrated in FIGS. 2, 4 and 5. The lifting bar 22 will then slide up the inclined surfaces of 18 and 18*a* and drop into the notches of the catch fittings and at the same time the pivot bar 24 will be raised off the bottom of the slots in sleeves 16 and 16*a* and again drop to the bottom of the slots, completing a solidly supported rack position for hanging in storage. In this position the garments bind each other and in transit will not work free from the hanger bars of the rack.

While the hanger is in storage position, the chains 48 and 48*a* hang free and can become entangled on rod ends, hooks, etc. Therefore, elastic bands 50 and 50*a*, either of which can double its length without greatly increasing resistance, are installed at the looped bottom of the chains and connected to the pivot bar 24, one to each, and have slacked tension when in storage. These elastic bands are termed "chain tenders" and are illustrated in FIGS. 2, 3 and 4 in operational sequence.

In addition it has been proved by a model in use that, contrary to appearance, a chosen pair of trousers on any one of the disconnect rack bars can be easily removed even while the rack is in storage position, simply and cleanly, by lifting the free end of the trousers supporting bar out of its hook, grasping the creases of the trousers wanted, and exerting a sharp pull to the right. This will have little effect upon neighboring garments. The pivot bar 24 is a practical place to hang a pair of denims or sun-tans. Anyone can soon learn the simple operational methods of this practical hanger assembly.

I have described what I believe to be the best embodiment of my invention. What I desire to cover by letters patent, however, is set forth in the appended claims.

1. A portable, multiple garment carrier comprising, in combination, (a) a rigid carrier frame which includes suspending means for detachably supporting the carrier frame from a hanger hook and laterally spaced side members that extend downward therefrom when the carrier frame is in suspended position, (b) a rectangular rack frame for garments and other articles, having bearing means at its normally lower end through which it is pivotally supported from the lower part of said rigid carrier frame, and including a series of spaced, horizontally extending garment bearing rack bars, each affixed at one of its ends to the rack frame and normally releasably confined at its opposite end by a retaining hook affixed to the opposite end of the garment bearing rack frame, and (c) flexible means of limited length connecting the fixedly supported carrier frame member to the garment bearing rack frame, the construction and arrangement being such that the rack frame can be swung down to a position in which the articles draped on the several individual bars of the rack frame are separated and hang clear of one another, and any selected garment bearing rack frame bar can be moved clear of its hook for permitting any article carried by it to be withdrawn lengthwise of the carrying rack frame bar, latching means being provided on the bearing frame for normally retaining the garment bearing rack in a substantially vertical position, the garment carrying rack being pivotally supported by the bearing frame in slots of the bearing frame that extend upward, the latching means including upwardly sloping hooks that terminate in retaining slots, and the rack including means that ride up the hooks and drop into the slots thereof as the rack is swung to its vertical position to be retained by the hooks.

* * * * *